US007311652B2

(12) United States Patent
Henne

(10) Patent No.: US 7,311,652 B2
(45) Date of Patent: Dec. 25, 2007

(54) FIXING DEVICE FOR A CENTRIFUGE ROTOR COVER

(75) Inventor: Sebastian Henne, Göttingen (DE)

(73) Assignee: Thermo Electron LED GmbH, Langenselbold (DE)

( * ) Notice: Subject to any disclaimer, the term of this patent is extended or adjusted under 35 U.S.C. 154(b) by 0 days.

(21) Appl. No.: 11/391,359

(22) Filed: Mar. 29, 2006

(65) Prior Publication Data

US 2006/0240963 A1 Oct. 26, 2006

(30) Foreign Application Priority Data

Mar. 29, 2005 (DE) ..... 10 2005 014 218

(51) Int. Cl.
*B04B 5/02* (2006.01)
*B04B 7/06* (2006.01)

(52) U.S. Cl. ..... 494/12; 494/16; 494/38

(58) Field of Classification Search ..... 494/12, 494/16, 38, 20, 33, 64, 84, 85; 210/232
See application file for complete search history.

(56) References Cited

U.S. PATENT DOCUMENTS 4,360,151 A * 11/1982 Cowell et al. ..... 494/10
5,344,380 A * 9/1994 Chern et al. ..... 494/12
6,056,684 A * 5/2000 Linder et al. ..... 494/12
2006/0240963 A1* 10/2006 Henne ..... 494/16

FOREIGN PATENT DOCUMENTS

DE 3805896 C1 * 3/1989

* cited by examiner

*Primary Examiner*—Charles E. Cooley
(74) *Attorney, Agent, or Firm*—Baker & Hostetler LLP

(57) ABSTRACT

The present invention relates to a fixing device of a cover for a centrifuge rotor, a receiving chamber of the centrifuge rotor, which is driven using a drive unit, for receiving samples to be centrifuged being closable aerosol-tight using the cover. The fixing device is provided with an opening so that the drive unit is accessible through the fixing device and the cover without removing the cover. The present invention has the advantage that the rotor may be removed from the centrifuge and the rotor remains closed aerosol-tight at the same time. In addition, simple, one-handed operation is made possible.

18 Claims, 3 Drawing Sheets

FIXING DEVICE FOR A CENTRIFUGE ROTOR COVER

CROSS-REFERENCE TO RELATED APPLICATIONS

This application claims priority to German patent application No. DE 102005014218.4 entitled, FIXING DEVICE FOR A CENTRIFUGE ROTOR COVER, filed Mar. 29, 2005, the disclosure of which is hereby incorporated by reference in its entirety.

FIELD OF THE INVENTION

The present invention relates to a fixing device of a cover for a centrifuge rotor, a receiving chamber of the centrifuge rotor, which is driven using a drive unit, for receiving samples to be centrifuged, being able to be closed aerosol-tight using the cover.

BACKGROUND OF THE INVENTION

For example, containers which are equipped with samples are received in a rotor of a centrifuge. At high speeds of the centrifuge, such strong forces act on the samples that separation into different components of the samples may be achieved. In order to increase safety during operation of a centrifuge, the opening of the rotor is closed using a closing device implemented as a cover before beginning the rotation. It is thus ensured that if a container breaks, for example, none of the particles to be separated may escape from the receiving chamber of the rotor.

If small quantities of liquids or aerosols escape into the receiving chamber of the centrifuge rotor due to vessel breakage during the centrifugation, it is necessary for the receiving chamber of the centrifuge rotor below the cover to be closed aerosol-tight in order to prevent the liquids or aerosols from escaping. Such a cover is fixed in rotors according to the related art using a thread or a bayonet closure, for example. A disadvantage of these achievements of the object is that such fixing is only possible using both hands and is therefore viewed as complex.

The fixing and removal of the cover of a centrifuge rotor may be performed more easily using a snap mechanism. The advantage is that one-handed mounting or dismounting of the cover is possible. However, if one wishes to remove the entire rotor with centrifuged samples from the centrifuge, for example, the cover must previously be removed in devices according to the related art. This is disadvantageous, since a receiving chamber of the centrifuge rotor which is possibly closed aerosol-tight must thus be opened.

SUMMARY OF THE INVENTION

It is therefore an object of the present invention to provide a fixing device for a cover, using which a receiving chamber of a centrifuge rotor for receiving samples to be centrifuged, which is driven using a drive unit, may be closed aerosol-tight, so that the cover may be mounted or dismounted one-handed and it is simultaneously possible to remove the rotor from the centrifuge without loosening or removing the cover of the centrifuge rotor.

This object is achieved according to the present invention in that the fixing device is provided with an opening, so that the drive unit is accessible through the fixing device and the cover without removing the cover.

According to a preferred embodiment, the fixing device has a catch element. A change from locking to unlocking of the cover may thus be performed easily.

According to a further preferred embodiment, the catch element of the fixing device interacts with a seal element between cover and centrifuge rotor in such way that ventilation of the receiving chamber between cover and centrifuge rotor is achievable.

This is advantageous, since a partial vacuum may arise in the receiving chamber after a closing procedure. For example, if the catch element interacts with the seal element after a horizontal displacement of the catch element, a pressure equalization with the surroundings may be achieved. This simplifies the handling when removing the cover.

According to a further preferred embodiment, the catch element is pressed into a locking position when the centrifuge rotor is rotating. A catch element designed in this way, having a catch element center of gravity placed on the side of the locking position, for example, increases the operational reliability of the centrifuge.

According to a further preferred embodiment, the catch element is displaceable into a locking position using spring force. This is advantageous since a snap closure may thus be achieved and the operability of the device is made easier and the security upon locking is increased.

According to a further preferred embodiment, the catch element interacts with a centrifuge rotor pin. Fixing near the rotor central axis is thus possible, so that a relatively low force and a low torque act on the catch element during the centrifuging operation. This allows the device to be constructed in way that saves material and weight.

According to a further preferred embodiment, the centrifuge rotor pin has an opening, so that the drive unit is accessible through the fixing device in the cover. If the drive unit is positioned below the rotor and the drive axis does not extend through the rotor, it is thus simple to remove the rotor from the drive unit.

According to a further preferred embodiment, the catch element is provided in a handle for the cover. One-handed operation of the catch element and/or the cover may thus be performed easily.

According to a further preferred embodiment, the catch element projects partially out of the handle. This makes one-handed operation of the catch element even easier.

According to a further preferred embodiment, the handle comprises at least two handle parts. Therefore, easy mounting of the catch element in the handle is possible.

The present invention also relates to a cover, using which a receiving chamber of a centrifuge rotor for receiving samples to be centrifuged may be closed aerosol-tight, a fixing device as described above being used.

The present invention also relates to a centrifuge rotor which has a cover as described above.

The present invention also relates to a centrifuge which has a centrifuge rotor as described above.

In the following, the present invention will be explained on the basis of preferred embodiments with reference to the drawing.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
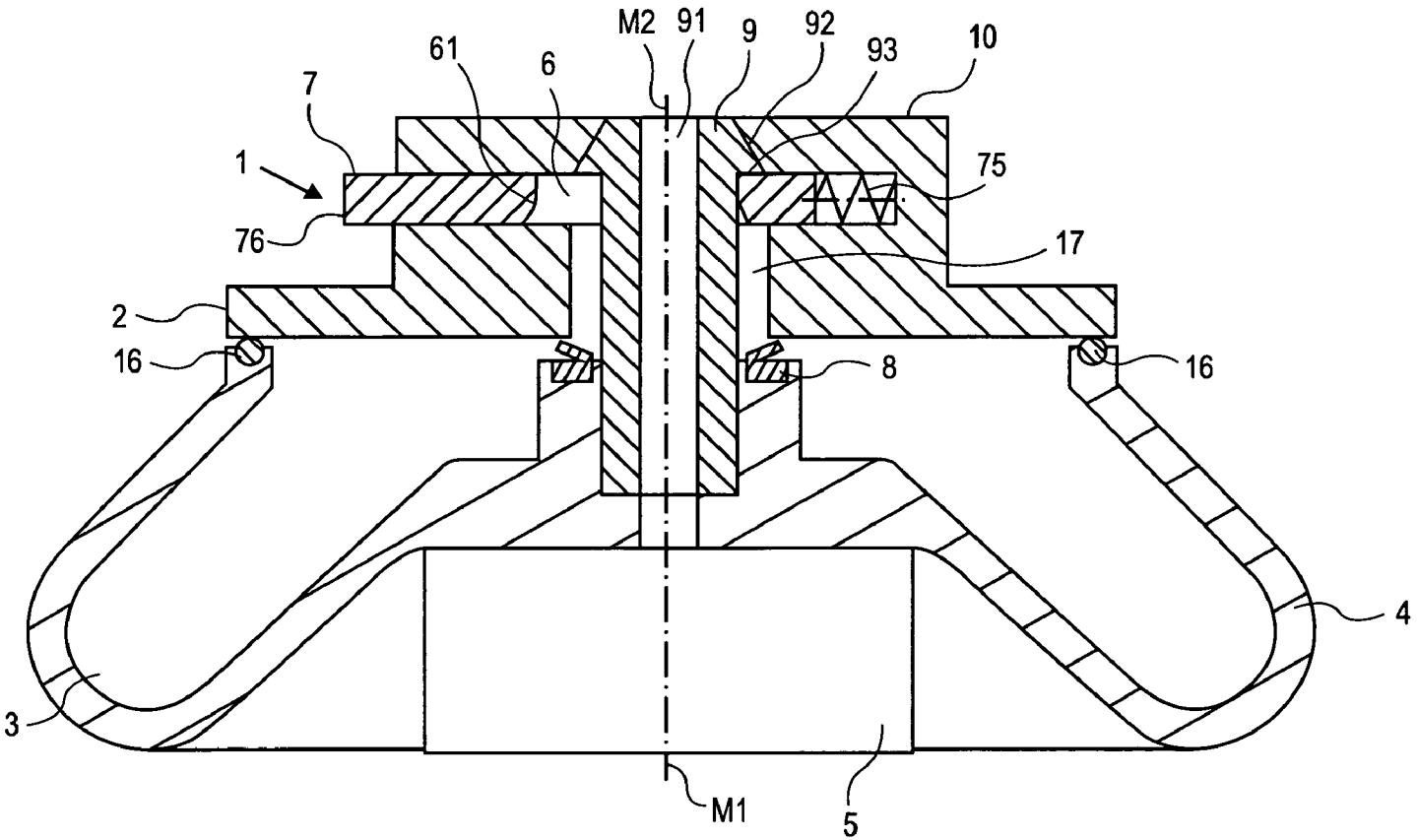
FIG. 1 shows a schematic cross-sectional view of a first embodiment of the present invention.

FIG. 1 shows a centrifuge rotor 4 having an associated closing device 2 in the form of a cover, using which a receiving chamber 3 in the form of an annular trough, which is formed by the centrifuge rotor 4 and the cover 2, may be closed. Containers having samples, which are subjected to a centrifugal force during operation of the centrifuge, may be received in the receiving chamber 3. The receiving chamber 3 is sealed by a first seal element 8 and a second seal element 16. The seal elements 8, 16 are preferably made of an elastic material.

The cover 2 is provided with a handle 10, which is implemented in one piece with the cover 2 in this embodiment. A fixing device 1 is provided in the handle 10, which has a catch element 7, which is received in the handle 10 so it is longitudinally displaceable. Using a compression spring 75, the catch element 7 is displaced into a locking position, a part 76 of the catch element 7 preferably partially projecting out of the handle 10 (to the left of the rotor central axis M1 in FIG. 1). The catch element 7 has an opening 6 in its middle area, which may thus be positioned in an unlocking position when the catch element 7 is displaced in the direction toward the compression spring 75, so that the cover 2 may be lifted off of the centrifuge rotor 4 and thus dismounted.

In this embodiment, the catch element 7 is locked to the centrifuge rotor 4 using a rotor pin 9. The rotor pin 9 is positioned centrally in the centrifuge rotor 4, so that its central axis M2 is congruent to the rotor central axis M1. On the side facing away from the rotor 4, the rotor pin 9 has a conical end 92 having an undercut 93, which interacts with the catch element 7. If the cover 2 having the catch element 7 and its opening 6, which is preferably implemented as circular and has a conical wall 61 for simplifying the mounting or dismounting, is placed on the rotor pin 9 and moved in the direction of the seal elements 8, 16 (from top to bottom in FIG. 1), the catch element 7 is pressed to the side (to the right in FIG. 1) by the conical end 92 of the rotor pin 9, until it reaches the undercut 93 and is displaced into the locking position using the compression spring 75. The cover is dimensioned in such way that the catch element 7 may only reach its locking position when the cover 2 has compressed the seal elements 8, 16 enough that an aerosol-tight closure of the receiving chamber 3 has been achieved.

Both the locking and also the unlocking of the cover 2 may be performed using one hand. During locking, the cover 2 is pressed onto the rotor pin 9 until the catch element 7 engages behind the undercut 93. During unlocking, the catch element 7 is displaced to the side (using a finger, for example) with the part 76 projecting out of the handle 10 in the direction of the compression spring 75, until the opening 6 is positioned so that the undercut 93 no longer contacts it and therefore the cover 2 is no longer pressed by the rotor pin 9 in the direction toward the receiving chamber 3.

Furthermore, if it is desired that the centrifuge rotor 4 including the still attached cover 2 be removed from the centrifuge and/or the drive unit 5, in the embodiment shown in FIG. 1, a tool, such as a hexagon key, may be guided through the opening 6 of the fixing device 1, the opening 17 of the cover 2, and the opening 91 of the rotor pin 9 to the drive unit 5 positioned below the centrifuge rotor 4. Using the openings 6, 17, and 91 it is possible for an aerosol-tight closed receiving chamber 3 to be maintained even as the centrifuge rotor 4 is removed from the drive unit 5. Loosening the cover 2 to remove the rotor 4, as is still typical in the related art, is therefore no longer required.

Figure 2:
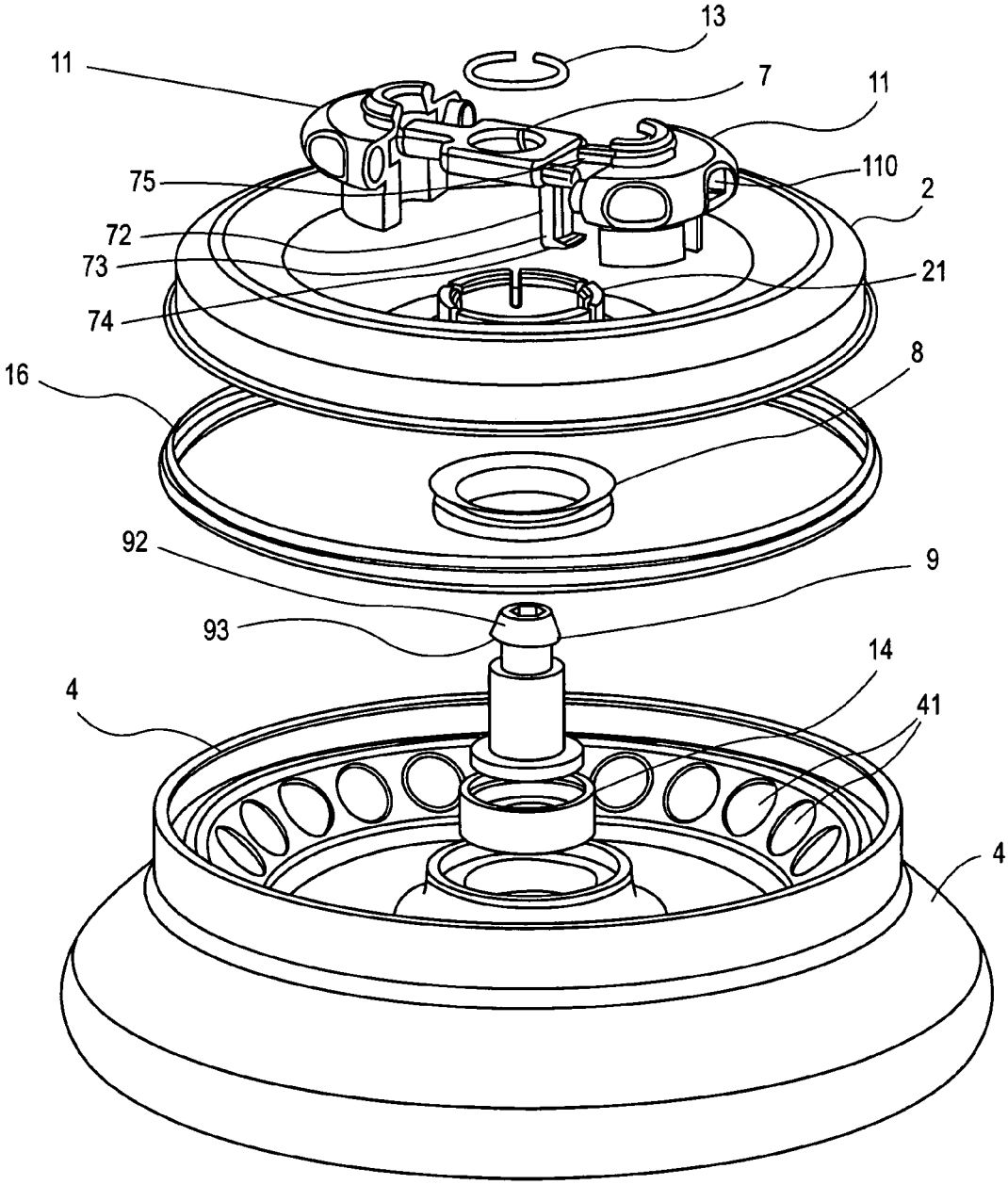
FIG. 2 shows an exploded illustration of a second embodiment of the present invention.

An exploded illustration of a second embodiment of the present invention is illustrated in FIG. 2. The centrifuge rotor 4 has receptacles 41 for containers having samples to be centrifuged. Furthermore, a rotor pin 9 is provided centrally in the centrifuge rotor 4, which is mounted in a pin receptacle 14, see FIG. 3. The pin receptacle 14 is mounted using a press fit in the centrifuge rotor 4, for example, while the rotor pin 9 is mounted so it is rotatable in the pin receptacle 14 with play. The pin receptacle 14 has a groove 15, into which a securing ring (not shown) is inserted, which prevents the collar 94 of the rotor pin 9 from moving vertically along the rotor central axis M1. A first seal element 8 is mounted around the pin receptacle 14 under radial tension.

Figure 3:
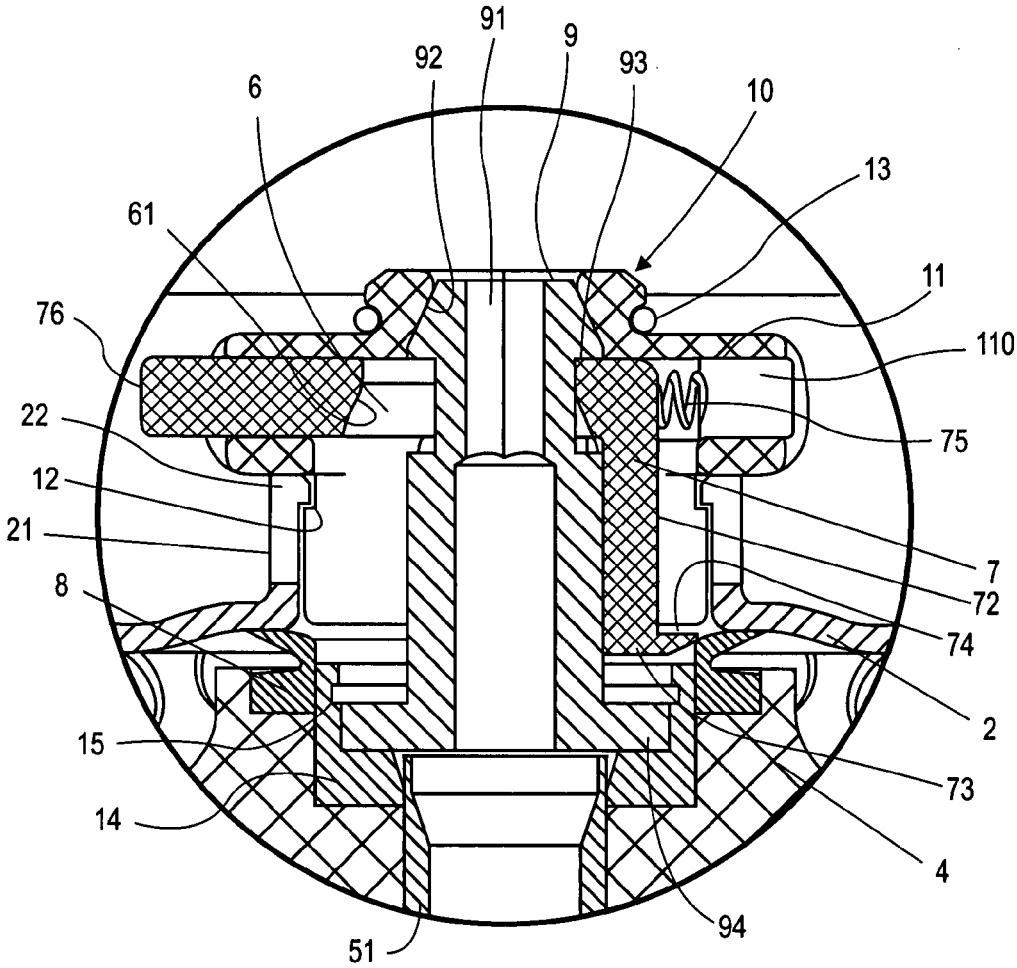
FIG. 3 shows a detail of a schematic cross-sectional view of the second embodiment of the present invention.

The handle 10 has two handle halves 11, which are held together in their upper area using a securing ring 13 and in their lower area using a cylindrical terminus 21 of the cover 2, see FIG. 3. The cylindrical terminus 21 has catch lugs 22, which engage in a peripheral groove 12 of the handle 10 when the handle 10 is inserted in the cover 2. Before the handle 10 is inserted, the catch element 7 is mounted in the handle halves 11. For this purpose, the catch element partially engages in the recess 110 of the handle halves 11. The catch element 7 has an arm 72, directed perpendicularly downward in relation to the horizontal displacement direction of the catch element 7, which is provided with a wedge 74 on its arm end 73, in this embodiment. The wedge 74 is implemented so that it may interact with the first seal element 8 in such way that upon a longitudinal displacement (horizontal movement) of the catch element 7 in the direction toward the compression spring 75 in the case of a partial vacuum in the receiving chamber 3, ventilation of the receiving chamber 3 between the cover 2 and the centrifuge rotor 4 is achieved.

The center of gravity of the catch element 7 is at a position laterally of the rotor central axis M1 on the side facing away from the compression spring 75, on the side to the left of the rotor central axis M1 in FIG. 3. It is thus ensured during centrifuging operation that the cover 2 may not open independently, so that a high operational reliability is achieved.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A fixing device for a cover of a centrifuge rotor, comprising:

a receiving chamber defined by the centrifuge rotor which is driven using a drive unit for receiving samples to be centrifuged; and wherein the cover closes the receiving chamber, and wherein the fixing device is provided with an opening, so that the drive unit is accessible through the fixing device and the cover without removing the cover, wherein the fixing device has a catch element, wherein the catch element is displaceable into a locking position using spring force.

2. The fixing device according to claim 1, wherein the catch element interacts with a seal element between cover and centrifuge rotor in such way that ventilation of the receiving chamber between cover and centrifuge rotor is achievable.

3. The fixing device according to claim 1, wherein the catch element is pressed into a locking position when the centrifuge rotor is rotating.

4. The fixing device according to claim 1, wherein the catch element interacts with a centrifuge rotor pin.

5. The fixing device according to claim 4, wherein the centrifuge rotor pin has an opening, so that the drive unit is accessible through the fixing device and the cover.

6. The fixing device according to claim 1, wherein the catch element is provided in a handle for the cover.

7. The fixing device according to claim 6, wherein the catch element projects partially out of the handle.

8. The fixing device according to claim 6, wherein the handle comprises at least two parts.

9. A cover for a receiving chamber of a centrifuge rotor for receiving samples to be centrifuged, which may be closed gas-tight, comprising:

a fixing device, further comprising:

a receiving chamber defined by the centrifuge rotor which is driven using a drive unit for receiving samples to be centrifuged; and wherein the cover closes the receiving chamber, and wherein the fixing device is provided with an opening, so that the drive unit is accessible through the fixing device and the cover without removing the covers, wherein the fixing device has a catch element, wherein the catch element is provided in a handle for the cover, wherein the catch element projects partially out of the handle.

10. The cover according to claim 9, wherein the catch element interacts with a seal element between cover and centrifuge rotor in such way that ventilation of the receiving chamber between cover and centrifuge rotor is achievable.

11. The cover according to claim 9, wherein the catch element is pressed into a locking position when the centrifuge rotor is rotating.

12. The cover according to claim 9, wherein the catch element interacts with a centrifuge rotor pin.

13. The cover according to claim 12, wherein the centrifuge rotor pin has an opening, so that the drive unit is accessible through the fixing device and the cover.

14. The cover according to claim 9, wherein the handle comprises at least two parts.

15. A centrifuge rotor used with a centrifuge, comprising:

a cover for the centrifuge rotor;

a fixing device for the cover;

a receiving chamber defined by the centrifuge rotor which is driven using a drive unit for receiving samples to be centrifuged; and wherein the cover closes the receiving chamber, and wherein the fixing device is provided with an opening, so that the drive unit is accessible through the fixing device and the cover without removing the cover, wherein the fixing device has a catch element, wherein the catch element is displaceable into a locking position using spring force.

16. The centrifuge rotor according to claim 15, wherein the catch element is provided in a handle for the cover, wherein the catch element projects partially out of the handle.

17. A centrifuge, comprising:

a centrifuge rotor;

a cover for the centrifuge rotor, further comprising a receiving chamber defined by the centrifuge rotor which is driven using a drive unit for receiving samples to be centrifuged; and a fixing device for the cover, wherein the cover closes the receiving chamber, and wherein the fixing device is provided with an opening, so that the drive unit is accessible through the fixing device and the cover without removing the cover, wherein the fixing device has a catch element, wherein the catch element is displaceable into a locking position using spring force.

18. The centrifuge according to claim 17, wherein the catch element is provided in a handle for the cover, wherein the catch element projects partially out of the handle.

* * * * *

UNITED STATES PATENT AND TRADEMARK OFFICE

CERTIFICATE OF CORRECTION

PATENT NO. : 7,311,652 B2
APPLICATION NO. : 11/391359
DATED : December 25, 2007
INVENTOR(S) : Sebastian Henne It is certified that error appears in the above-identified patent and that said Letters Patent is hereby corrected as shown below:

In column 2, line 32, change "in way that saves material" to --in a way that saves material--.

In column 2, line 60, change "embodiments with reference to the drawing." to --embodiments with reference to the drawings.--.

In claim 9, column 5, line 56, change "the cover without removing the covers," to --the cover without removing the cover,--, as appears in the Amendment dated July 23, 2007 at page 4, claim 11, now claim 9.

In claim 10, column 6, lines 5-8, change "The cover according to claim 9, wherein the catch element interacts with a seal element between cover and centrifuge rotor in such way that ventilation of the receiving chamber between cover and centrifuge rotor is achievable." to --The cover according to claim 9, wherein the catch element interacts with a seal element between the cover and centrifuge rotor in such a way that ventilation of the receiving chamber between the cover and centrifuge rotor is achievable.--.

Signed and Sealed this

Fifth Day of May, 2009

John Doll

JOHN DOLL
*Acting Director of the United States Patent and Trademark Office*